US008881569B2

(12) United States Patent
Seilinger et al.

(10) Patent No.: US 8,881,569 B2
(45) Date of Patent: Nov. 11, 2014

(54) ROLLING MILL STAND FOR THE PRODUCTION OF ROLLED STRIP OR SHEET METAL

(75) Inventors: Alois Seilinger, Linz (AT); Markus Widder, Linz (AT)

(73) Assignee: Siemens Vai Metals Technologies GmbH (AT)

( * ) Notice: Subject to any disclaimer, the term of this patent is extended or adjusted under 35 U.S.C. 154(b) by 857 days.

(21) Appl. No.: 12/304,952

(22) PCT Filed: Jun. 13, 2007

(86) PCT No.: PCT/EP2007/005217
§ 371 (c)(1),
(2), (4) Date: Jun. 18, 2009

(87) PCT Pub. No.: WO2007/144161

PCT Pub. Date: Dec. 21, 2007

(65) Prior Publication Data

US 2009/0314047 A1 Dec. 24, 2009

(30) Foreign Application Priority Data

Jun. 14, 2006 (AT) ..... A 1021/2006

(51) Int. Cl.

| | |
|---|---|
| ***B21B 13/14*** | (2006.01) |
| ***B21B 29/00*** | (2006.01) |
| *B21B 27/02* | (2006.01) |
| *B21B 13/02* | (2006.01) |

(52) U.S. Cl.

CPC ..... *B21B 13/142* (2013.01); *B21B 2027/022* (2013.01); *B21B 27/021* (2013.01); *B21B 2013/025* (2013.01); *B21B 2013/028* (2013.01)

USPC ..... 72/252.5; 72/240; 72/241.2; 72/243.6

(58) Field of Classification Search

USPC ..... 72/240, 249, 234, 247, 252.5, 241.2, 72/243.6

See application file for complete search history.

(56) References Cited

U.S. PATENT DOCUMENTS

| | | | | |
|---|---|---|---|---|
| 3,857,268 | A | 12/1974 | Kajiwaka | 72/247 |
| 4,519,233 | A * | 5/1985 | Feldmann et al. | 72/243.6 |

(Continued)

FOREIGN PATENT DOCUMENTS

| | | |
|---|---|---|
| AT | 410765 B | 7/2003 |
| CN | 1555297 | 12/2004 |

(Continued)

OTHER PUBLICATIONS

International Search Report dated Sep. 10, 2007, issued in corresponding international application No. PCT/EP2007/005217.

(Continued)

*Primary Examiner* — Shelley Self
*Assistant Examiner* — Pradeep C Battula
(74) *Attorney, Agent, or Firm* — Ostrolenk Faber LLP

(57) ABSTRACT

A rolling mill stand for the production of rolled strip or sheet metal includes working rolls which are supported on respective supporting rolls or on intermediate rolls which are supported on supporting rolls. At least one of the rolls having a barrel contour which runs over the entire effective barrel length and can be described by a non-linear function. The barrel contour of this at least one roll having chamfers in at least one of the marginal regions of its longitudinal extent and the chamfers forming a corrected barrel contour in these marginal regions, so that inhomogeneities in the load distribution along the contact line of two adjacent rolls, and in particular in the region of the edges of the strip, are minimized. The corrected barrel contour is obtained by subtracting any non-linear mathematical chamfer function from the contour function described by the non-linear function, so that the pitch of the barrel contour and the pitch of the corrected barrel contour at a transition point from the barrel contour to the corrected barrel contour are identical.

14 Claims, 10 Drawing Sheets

(56) References Cited

U.S. PATENT DOCUMENTS

| | | | | |
|---|---|---|---|---|
| 4,781,051 | A | 11/1988 | Schultes et al. | |
| 4,800,742 | A | 1/1989 | Feldmann et al. | 72/247 |
| 4,881,396 | A | 11/1989 | Seidel et al. | 72/247 |
| 4,955,221 | A | 9/1990 | Feldmann et al. | |
| 5,622,073 | A * | 4/1997 | Hiruta et al. | 72/247 |
| 6,119,500 | A | 9/2000 | Ginzburg et al. | 72/247 |
| 6,868,707 | B2 | 3/2005 | Nishi et al. | |
| 7,123,703 | B2 | 10/2006 | Hausmann et al. | 379/114.2 |
| 7,181,949 | B2 | 2/2007 | Haberkamm et al. | 72/243.6 |
| 7,316,146 | B2 * | 1/2008 | Seilinger et al. | 72/252.5 |
| 7,367,209 | B2 | 5/2008 | Ritter et al. | 72/247 |
| 2003/0164020 | A1 | 9/2003 | Haberkamm et al. | 72/241.2 |
| 2005/0034501 | A1 | 2/2005 | Seilinger et al. | |
| 2005/0044916 | A1 | 3/2005 | Honjo et al. | 72/243.6 |

FOREIGN PATENT DOCUMENTS

| | | | |
|---|---|---|---|
| DE | 101 02 821 | | 7/2002 |
| EP | 0 091 540 | A1 | 10/1983 |
| EP | 0 249 801 | A1 | 12/1987 |
| EP | 0 258 482 | A1 | 3/1988 |
| EP | 1 228 818 | A2 | 8/2002 |
| EP | 1 249 801 | | 10/2002 |
| EP | 1 228 818 | | 11/2008 |
| JP | 55-103201 | | 8/1980 |
| JP | 55103201 | A * | 8/1980 |
| JP | 58-187207 | | 12/1983 |
| JP | 59-56905 | | 4/1984 |
| JP | 03013218 | A | 1/1991 |
| RU | 1816235 | | 5/1993 |
| RU | 2 115 493 | | 7/1998 |
| RU | 1306468 | | 12/2004 |
| RU | 2003125863 | | 1/2005 |
| RU | 2004110929 | | 6/2005 |
| RU | 2 268 795 | | 1/2006 |
| RU | 2 280 518 | | 7/2006 |
| SU | 1355112 | | 11/1987 |
| WO | WO 02/09896 | | 2/2002 |
| WO | WO 02/09896 | A1 | 2/2002 |
| WO | WO 02/11916 | | 2/2002 |
| WO | WO 2005/058517 | | 6/2005 |
| WO | WO 2005/058517 | A1 | 6/2005 |
| WO | WO 2007/144161 | | 12/2007 |
| WO | WO 2007/144162 | | 12/2007 |

OTHER PUBLICATIONS

Decision on Grant dated Sep. 21, 2011 issued in corresponding Russian Application No. 2009100918 with English translation (4 pages).

Office Action mailed Aug. 28, 2012 in related U.S. Appl. No. 12/304,937.

Opposition dated Aug. 25, 2011 issued in corresponding European Application No. 07725994.3 with English translation (25 pages).

Jürgen Seidel, "CSP Plant Design and Roll Implications"; Vortrag and Veröffentlichung, Rolls 2003, 9-11, ICC, Birmingham, UK (2003).

Mit nachträglichen Eriäuterungen versehene Figuren 7 and 9 (5 Seiten), (2003).

R. Lathe et al., "Optimisation of the rolling process (pass scheduling) to avoid roll spalling and surface defects", Final Report der European Commission, technical steel research, EUR 22054 (2006).

"Optimising of the rolling process (pass scheduling) to avoid roll spalling and defects", Cordis Angaben zum Veröffentlichungdatum von 2.) (5 Seiten), (2006).

F. Decultieux et al., "Backup Roll Chamfer Design, Profile and Maintenance", Teilablichtung aus der MS&T Conference Proceedings pp. 311-321, (2004).

Bai Zhenhua et al., "Research of the Roll Crown Optimization on Skin Pass Mill in Baosteel 2050 Hot Rolling Plant", Iron and Steel, vol. 37, No. 9 (2002) pp. 35-38.

* cited by examiner

ROLLING MILL STAND FOR THE PRODUCTION OF ROLLED STRIP OR SHEET METAL

CROSS REFERENCE TO RELATED APPLICATION

The present application is a 35 U.S.C. §§371 national phase conversion of PCT/EP2007/005217, filed Jun. 13, 2007, which claims priority of Austrian Application No. A102/2006, filed Jun. 14, 2006, incorporated by reference herein. The PCT International Application was published in the German language.

BACKGROUND OF THE INVENTION

The invention relates to a rolling mill stand for the production of rolled strip or sheet metal, with working rolls which are supported on supporting rolls or on intermediate rolls which are in turn supported on supporting rolls. At least one of these rolls has a barrel contour which runs over the entire effective barrel length and can be described by a non-linear function. The barrel contour of this at least one roll has chamfers in at least one of the marginal regions of its longitudinal extent and forms a corrected barrel contour in these marginal regions.

In four-high rolling mill stands or six-high rolling mill stands, it is common practice to equip at least the two working rolls or the two intermediate rolls (in the six-high stand), but in some cases also the supporting rolls, with a special barrel contour and to provide axially acting adjustment devices for these working rolls or supporting rolls, so that the roll nip contour can be set as a function of the current rolled strip profile.

A rolling mill stand of this type is already known, for example, from AT 410765 B. The roll barrel contour of these rolls known among specialists by the designation SmartCrown® can be described mathematically by a modified sine function. A suitable choice of the contour parameters results in this case in a cosinuoidal clear roll nip, the amplitude of which can be influenced in a directed way by the axial displacement of the rolls. The rolls of rolling mill stands may, however, also have many other barrel contours, which are for example distinguished by a contour shape that is cylindrical, bulging, concavely-convexly curved or curved in some other way.

When working rolls or intermediate rolls with the barrel contour known from AT 410765 B and cylindrically shaped supporting rolls are used in four-high or six-high rolling mill stands, as is normally customary, it is unavoidable that load distributions which are inhomogeneous occur between the supporting rolls and the directly adjacent rolls during continuous rolling operation. Since the crowning region to be covered with the aid of the contoured rolls is always determined by the requirements of the rolling process, such as, for example, by different process parameters, dimensions and deformation properties of the rolling stock, the displacement stroke of the contoured rolls is the only influencing variable with which the markedness of the inhomogeneity of the load distribution can be influenced. Such measures are characterized by the requirement for the producer of the rolling stock to produce strips and sheets with ever narrower tolerance ranges.

In addition, excessive edge pressings occur in conjunction with the other adjacent rolls, especially in the marginal regions of the supporting rolls. In order to avoid inadmissibly high edge pressings between the working rolls and supporting rolls or between the working rolls and intermediate rolls or intermediate rolls and supporting rolls, barrel ends of the rolls are usually chamfered and therefore have a clearance in these marginal regions. Clearances of this type are already known from EP 0 258 482 A1 or EP 1 228 818 A2. These clearances, in the case of contoured roll barrels, are formed in marginal regions with a barrel radius increasing toward the margin, by a cylindrical barrel end, as is illustrated in EP 0 258 482 A1, or, in the case of rolls with a cylindrical roll barrel contour, may be formed by a conical marginal region, as illustrated and described, for example, in EP 1 228 818 A2. In any event, where these known clearances are concerned, there is only a shift of the critical pressing from the barrel ends (edges) to the transition region between the remaining barrel contour and the contour of the chamfer, since, in this configuration of the chamfer, once again, a kink or bend or a kind of step formed in the contour profile of the roll barrel occurs.

WO 02/09896 A1 and WO 2005/058517 A1 disclose, for example, a two-stage rectified area of the barrel contour on working rolls in a four-high stand or on intermediate rolls on a six-high stand. Starting from the central barrel contour, a first rectified area is provided in the direction of the barrel end by applying an arc function, precisely the same problems as previously stated with respect to the earlier prior art occurring in the transitional region of the central barrel contour to the contour of the rectified areas. The first rectified area is followed by a second rectified area, which extends up to the barrel end of the roll and realizes a cylindrical barrel contour.

SUMMARY OF THE INVENTION

The object of the present invention, therefore, is to avoid the above-described disadvantages of the prior art and to propose a rolling mill stand, in which inhomogeneities in the load distribution along the contact line of the supporting rolls and their adjacent rolls is minimized and, in particular, local load peaks in the load distribution profile, especially in the edge region, are reduced and, consequently, the duration of use of the rolls and the necessary regrinding intervals are increased. Another object is to eliminate kinks, bends or steps at the transition from the barrel contour to a chamfer at an end of the roll.

A rolling mill stand for the production of rolled strip or sheet metal, includes working rolls which are supported on respective supporting rolls or are supported on intermediate rolls which are in turn supported on supporting rolls. At least one of the rolls has a barrel contour which runs over the entire effective barrel length and can be described by a non-linear function. The barrel contour of this at least one roll has chamfers in at least one of the marginal regions of its longitudinal extent and the chamfers form a corrected barrel contour in these marginal regions, so that inhomogeneities in the load distribution along the contact line of two adjacent rolls, and in particular in the region of the edges of the strip, are minimized.

In a rolling mill stand of the type initially described, the above stated object is achieved in that the corrected barrel contour is obtained by subtracting any non-linear mathematical chamfer function from the contour function described by the non-linear function, and by the pitch of the barrel contour and the pitch of the corrected barrel contour at the transition point from the barrel contour to the corrected barrel contour being identical. The non-linear function may be any suitable function, of which examples are herein disclosed. This avoids a kink, bend or step forming at or near the transition point. As a result of the foregoing, there is no local pressure and the pressure distribution along the contact length is smoother, relative to known chamfer arrangements, and the pressure distribution does not show local peaks. The subtraction feature has the effect that at a transition point, the pitch of the barrel contour and the pitch of the chamfer contour remains the same for various chamfer configurations. As a result, a clearance is achieved on the mutually opposing barrel contours of adjacent rolls along a defined chamfer length.

Very good results with regard to minimizing and equalizing the load distribution are achieved when the chamfer function is formed by a trigonometric function. It is of principal importance here that the pitch of the barrel contour and the pitch of the corrected barrel contour at the transition point from the barrel contour to the corrected barrel contour are identical. Similarly good results are also achieved when the chamfer function is formed by a sine function or a second order function, for example a parabolic function, that is, non-linear functions.

Expediently, the supporting rolls in a four-high stand and the supporting rolls or the intermediate rolls in a six-high stand are provided with a corrected barrel contour.

Further advantages and features of the present invention may be gathered from the following description of unrestrictive exemplary embodiments, reference being made to the accompanying Figures in which:

DESCRIPTION OF PREFERRED EMBODIMENTS

In FIGS. 1 to 4, the load distribution between the supporting rolls and working rolls in the case of a roll barrel contour according to the prior art is compared with the load distribution between supporting rolls and working rolls in a roll barrel contour according to the invention using the example of a four-high stand.

Figure 1:
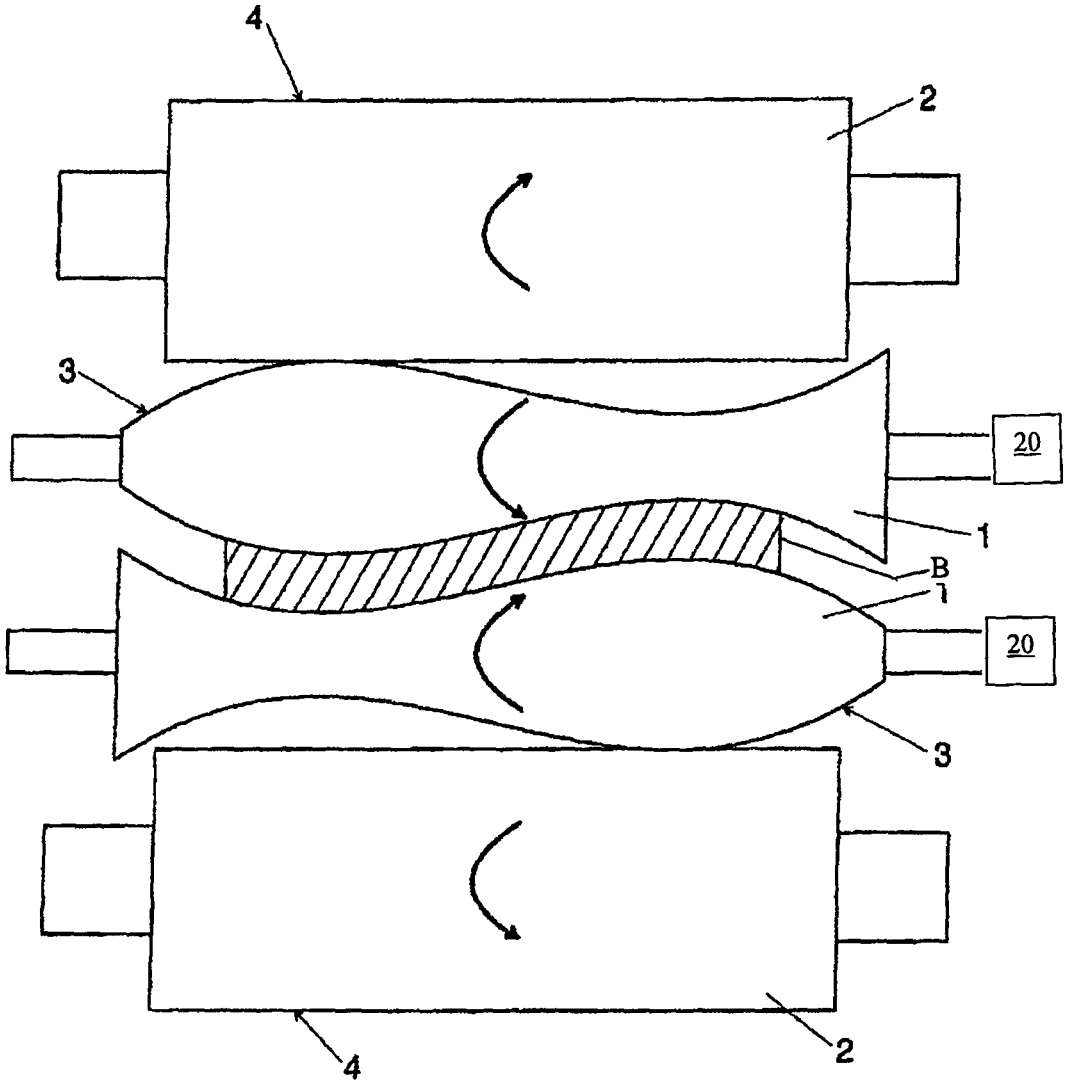
Fig. 1 PRIOR ART
FIG. 1 shows a diagrammatical illustration of a four-high stand with contoured working rolls and cylindrical supporting rolls according to the prior art.
Figure 2:
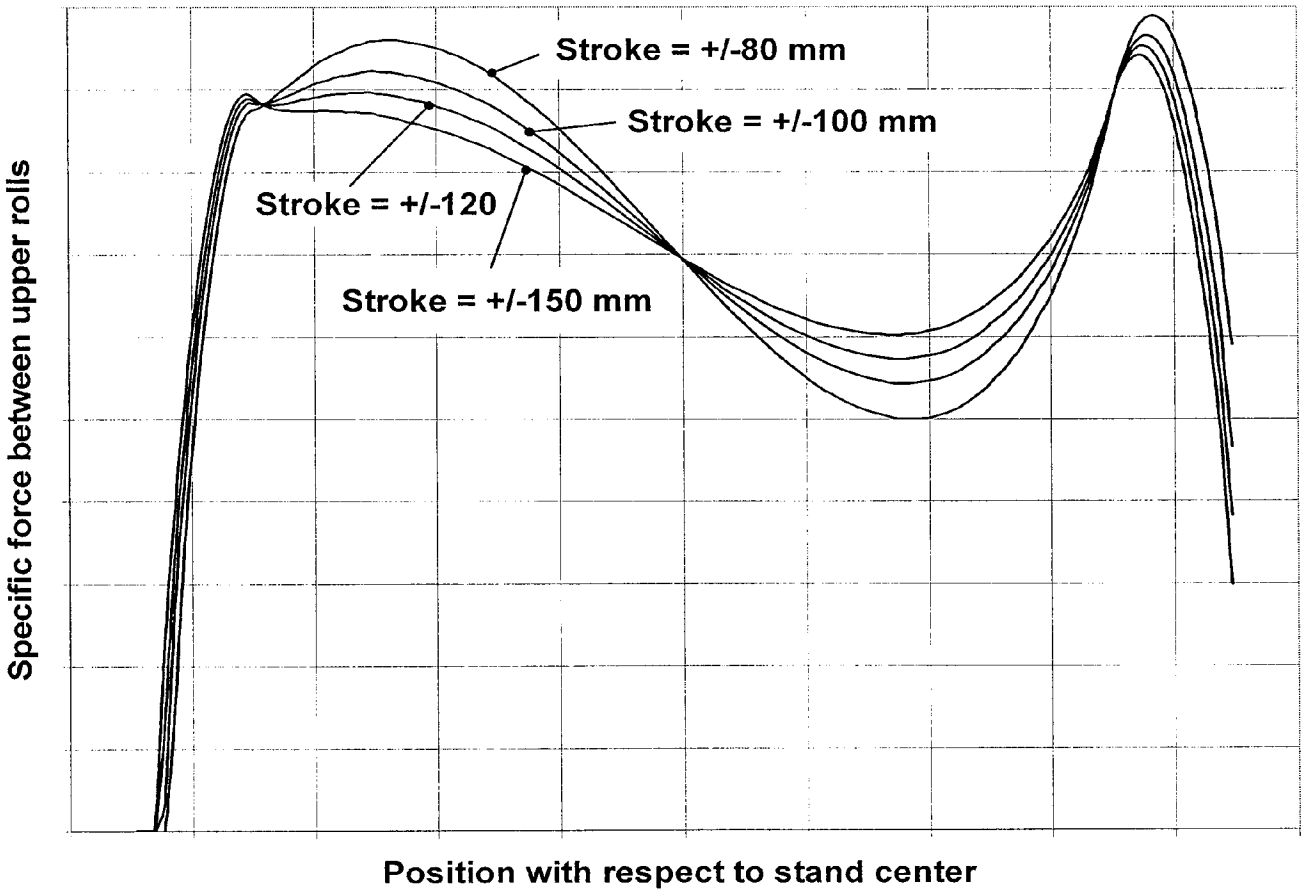
FIG. 2 PRIOR ART
FIG. 2 shows the typical load distribution between the working rolls and supporting rolls in a four-high stand according to FIG. 1.

FIG. 1 shows a diagrammatic illustration of the roll arrangement in a four-high stand for rolling a metal strip B, in particular a steel strip, with working rolls 1 that extend and are positioned to define a nip through which the metal strip B is rolled. Respective supporting rolls 2 outward from the nip support each of the working rolls to define the nip. The axially displaceable working rolls 1 have in each case a barrel contour 3 which can be described by a concave-convex function. A device 20 known in the art is operable for displacing each roll or at least one roll axially with respect to each other. Each of the working rolls 1 is supported by a respective supporting roll 2 which has a cylindrical barrel contour 4 and which support rolling forces acting on the working rolls. The load distribution between the upper working roll 1 and the upper supporting roll 2 is illustrated in FIG. 2 for this illustrated case of roll barrel configuration. The specific force between the rolls is plotted against the barrel length, and, on the one hand, load peaks occur at the edge region of the rolls and, on the other hand, maximum and minimum values occur according to the convex/concave contour profile of the working roll. Load distribution curves already based on a chamfer function according to the prior art are illustrated for four selected values of the maximum relative axial displacement (displacement stroke) of the working rolls with respect to one another.

Figure 3:
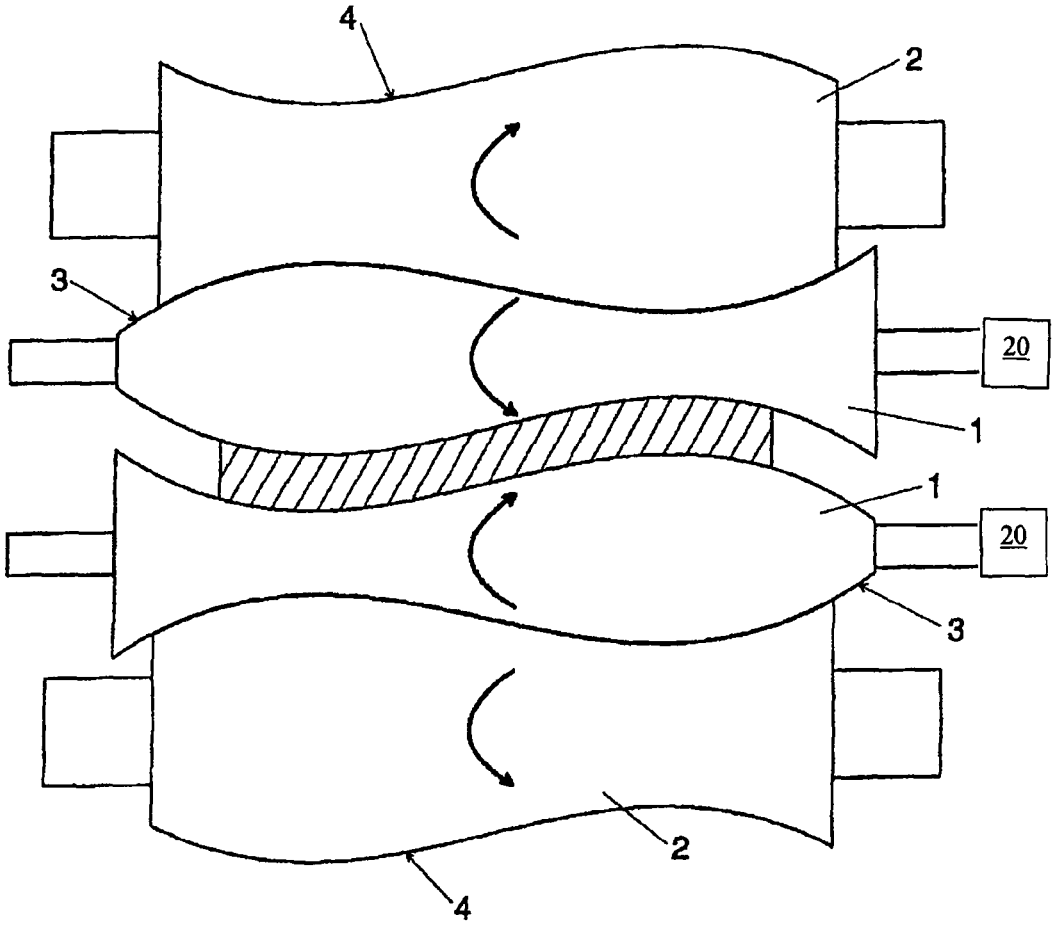
FIG. 3 shows a diagrammatic illustration of a four-high stand with contoured working rolls and complementary supporting rolls.
Figure 4:
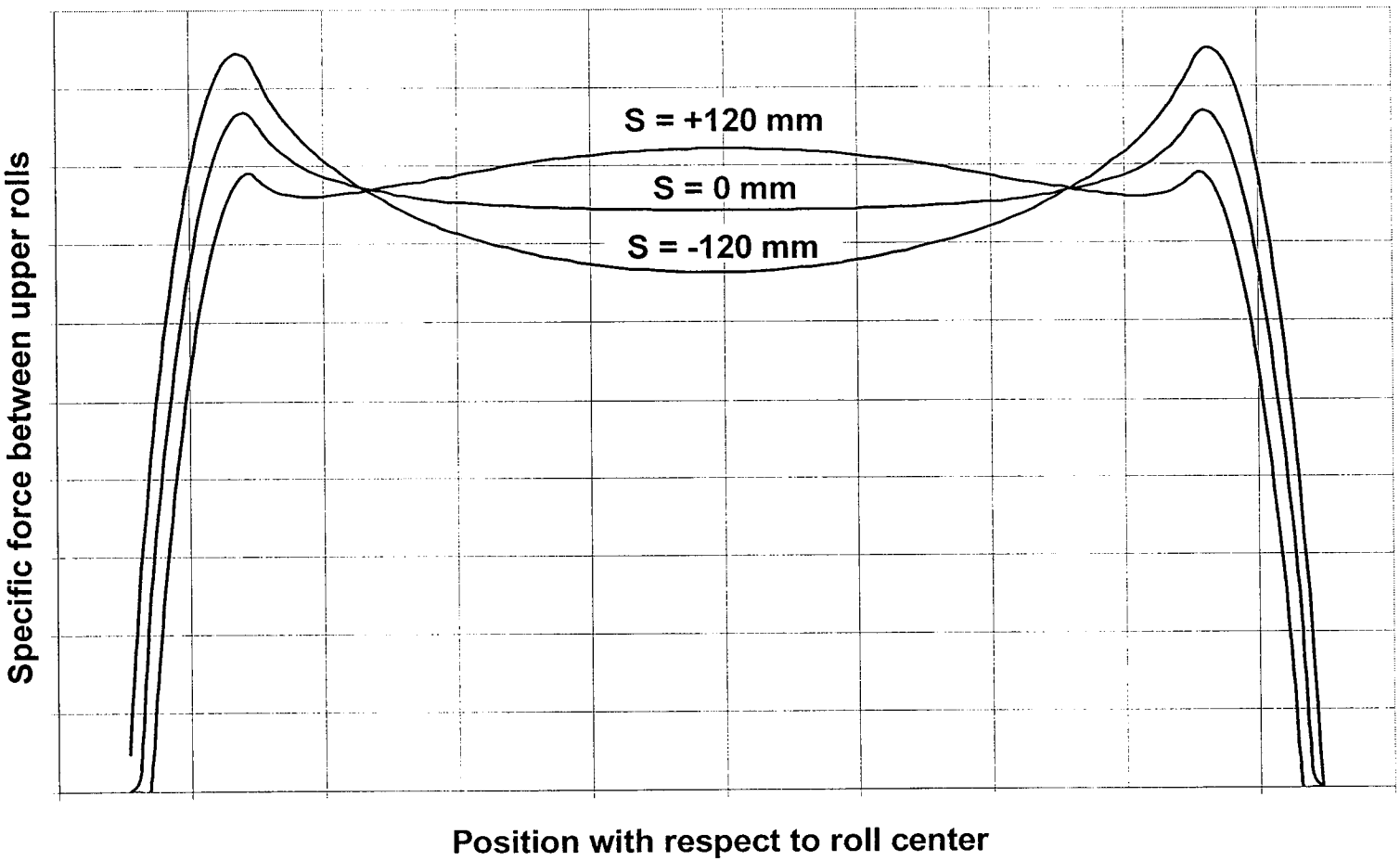
FIG. 4 shows the typical load distribution between the working rolls and supporting rolls in a four-high stand with the roll design as shown in FIG. 3.

FIG. 3 shows a diagrammatic illustration of the roll arrangement in a four-high stand with working rolls 1 and supporting rolls 2. The axially displaceable working rolls 1 displaceable by devices 20 have in turn, in each case, a barrel contour 3 which can be described by a non-linear function. These barrel contours complete one another in a complementary way in one specific relative axial position of the working rolls. The two supporting rolls 2 likewise have a mutually completing complementary barrel contour 4 which is likewise formed by a non-linear function, wherein the barrel contours of the respective adjacent interacting working roll 1 and supporting roll 2 complete one another fully in a non-loaded state. The load distribution between the upper working roll 1 and the upper supporting roll 2 is illustrated in FIG. 4 for this case of the roll barrel configuration, the illustrated load distribution already being based on a corrected barrel contour according to the invention in the edge region. Load peaks in the edge region occur to a differing extent as a function of the axial displacement. Overall, however, in the version according to the invention, a basic equalization of the load distribution over the roll barrel profile is exhibited.

Figure 5:
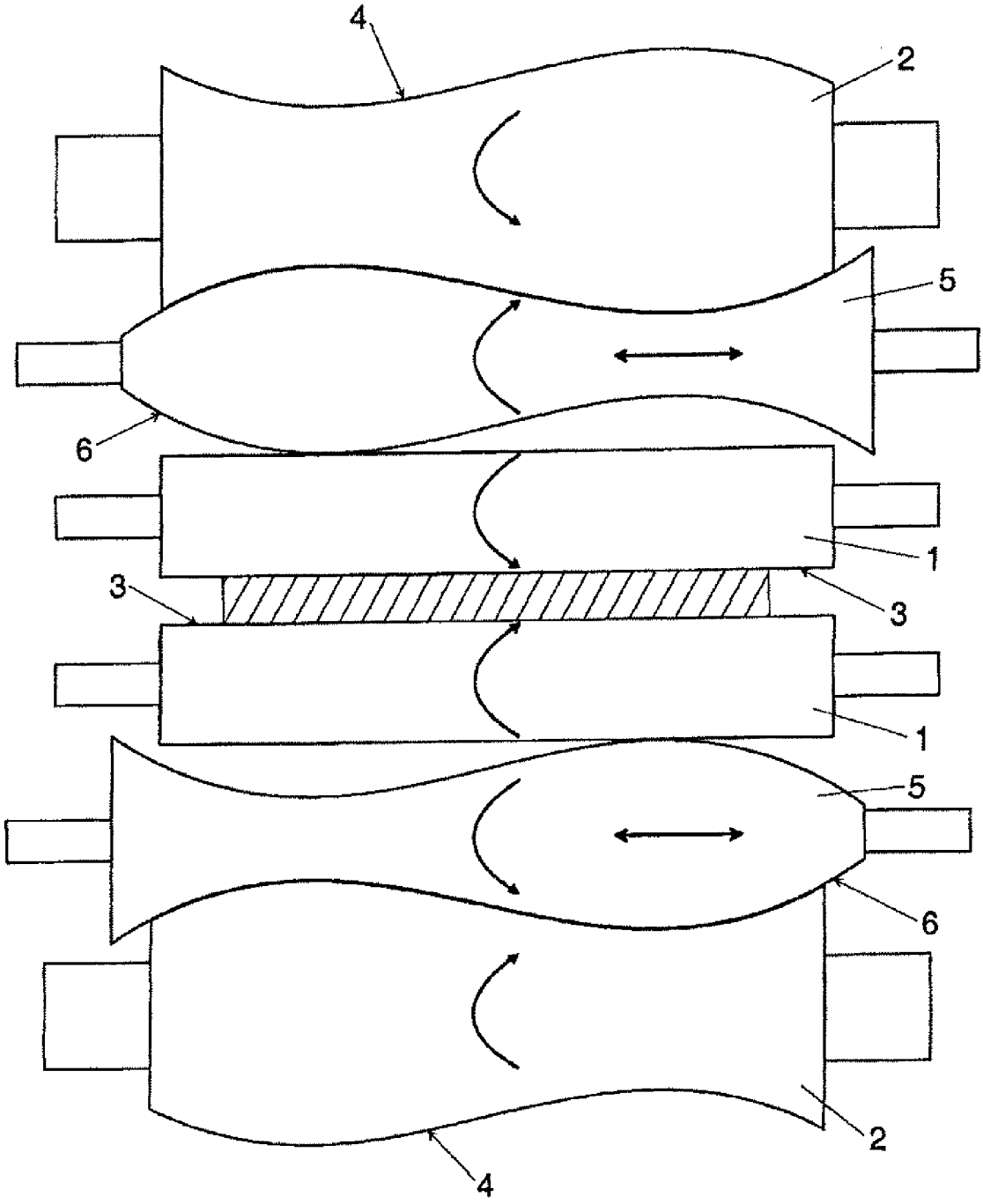
FIG. 5 shows a diagrammatic illustration of a six-high stand with contoured supporting rolls and complementary intermediate rolls according to the invention.

FIG. 5 shows a diagrammatic arrangement of the roll arrangement in a six-high stand with working rolls 1, intermediate rolls 5 and supporting rolls 2, the working rolls being supported via the intermediate rolls on the supporting rolls. The working rolls 1 are equipped with a cylindrical barrel contour 3. According to a further possible configuration, however, the working rolls may also have a barrel contour, as in FIG. 4, and then the barrel contour of the working rolls may also be oriented with respect to the barrel contour of the adjacent intermediate rolls. The intermediate rolls 5 have a barrel contour 6 which can be described by a non-linear function. The supporting rolls 2 likewise have a barrel contour 4 which can be described by a sine function. The barrel contours 4 of the supporting rolls 2 and the barrel contours 6 of the intermediate rolls 5 complete one another fully in the non-loaded state in the nondisplaced axial position of the axially adjustable intermediate rolls 5.

Figure 6:
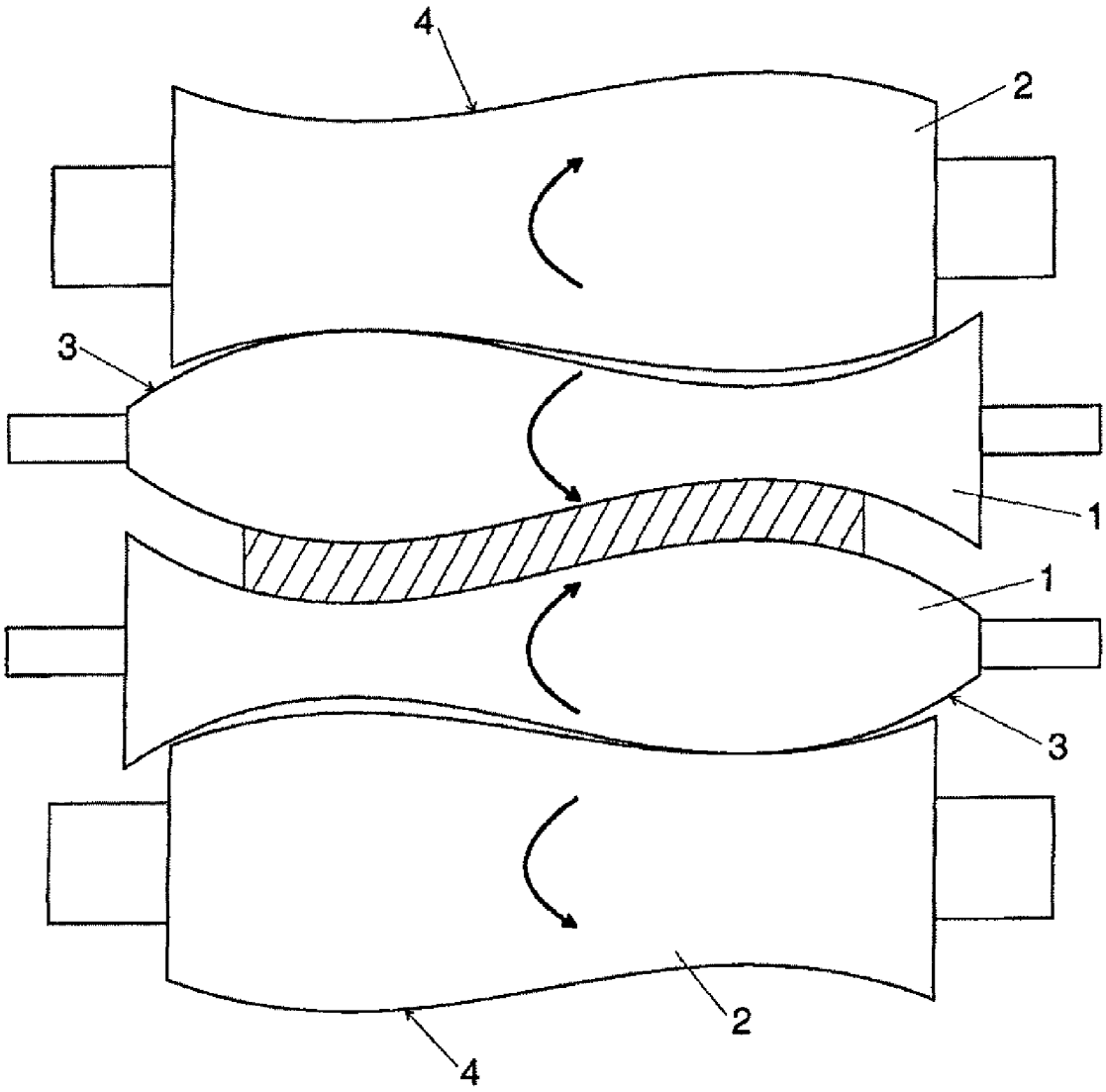
FIG. 6 shows a diagrammatic illustration of a four-high stand with contoured working rolls and complementary supporting rolls according to the invention, in which the barrel contours no longer complete one another fully.

FIG. 6 shows a diagrammatic illustration of working rolls 1 and supporting rolls 2 in a four-high stand, wherein the basic set-up of the barrel contours 3, 4 follows the embodiment according to FIG. 3. However, the contour profile is varied, with the result that there is in this case only a partial, if any, completion of the barrel contours of the supporting roll 2 and of the directly adjacent working roll 1 in the non-loaded state.

In the case where no completion of the barrel contours is provided, the barrel contours may also be chosen such that the contoured rolls have a positive or negative crowning.

According to an embodiment which is not illustrated, it is likewise possible in a six-high stand, in a similar way to FIG. 6, to choose the contour profile of the supporting rolls and the intermediate rolls such that there is in this case only a partial completion of the barrel contours of the supporting roll in the non-loaded state and of the directly adjacent intermediate roll in a non-loaded state.

Altogether, chamfer functions according to the invention can also be used for producing corrected barrel contours in the case of the barrel contours illustrated in FIGS. 5 and 6 and additionally described.

Figure 7:
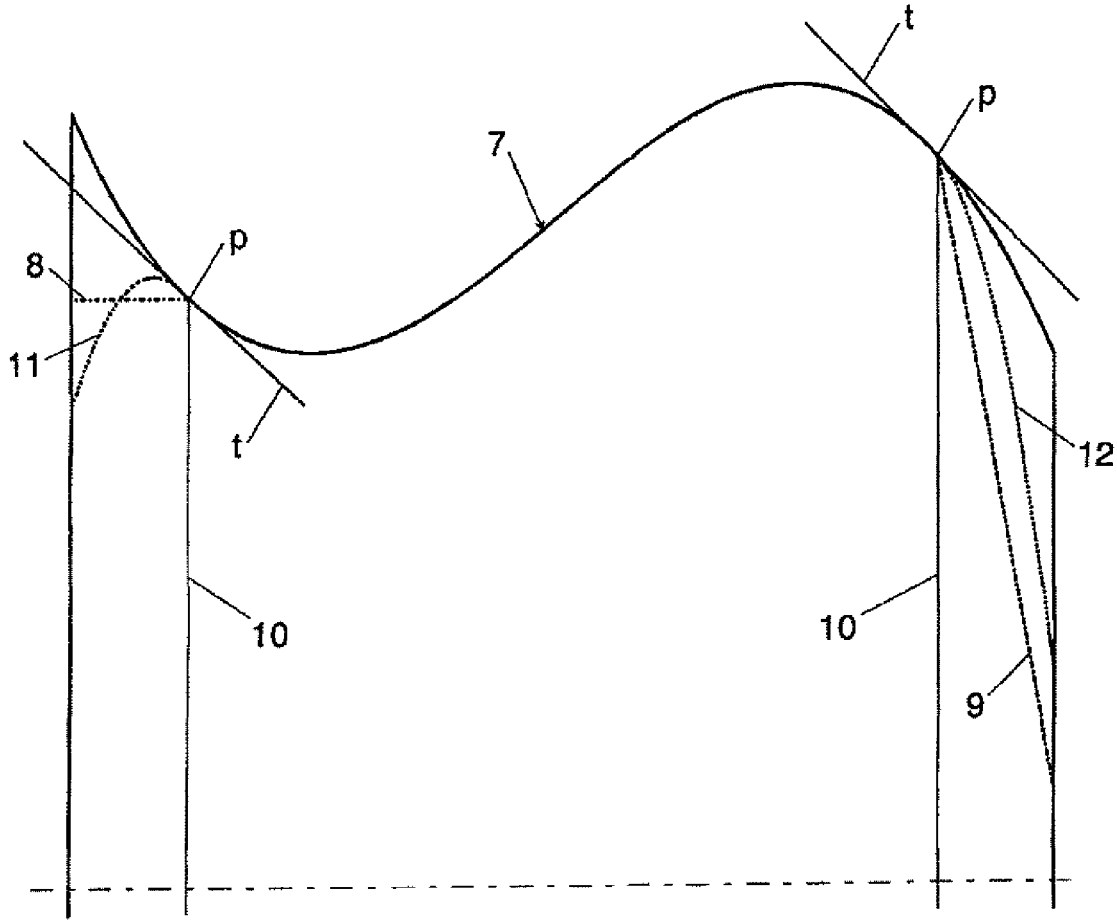
FIG. 7 shows the contour according to the invention of a supporting roll or an intermediate roll or a working roll taking account of a circular chamfer function in comparison with a barrel contour according to the prior art.

FIG. 7 illustrates the profile of the roll barrel contour 7 of a supporting roll or intermediate roll or working roll over the barrel length. Dashed and dotted lines 8, 9 illustrate possibilities, known from the prior art, for chamfering a roll in its end regions in order to avoid high edge pressings. The chamfer according to the dashed and dotted line 8 generates a cylindrical end region, and the chamfer according to the dashed and dotted line 9 generates a conical end region on the rolls, in both cases a kink or bend 10 occurring in the contour profile over the barrel length, which kink forms a continuous edge on the roll. An improvement in the load conditions arises due to a chamfer according to the invention which gradually approaches the barrel contour, thus giving rise on both sides or both end margins to a corrected barrel contour which is illustrated by the dotted lines 11 and 12. At the transition point P of the barrel contour into the corrected barrel contour, both curved profiles of the barrel contour and the corrected barrel contour are the same pitch as the tangent t.

Figure 8:
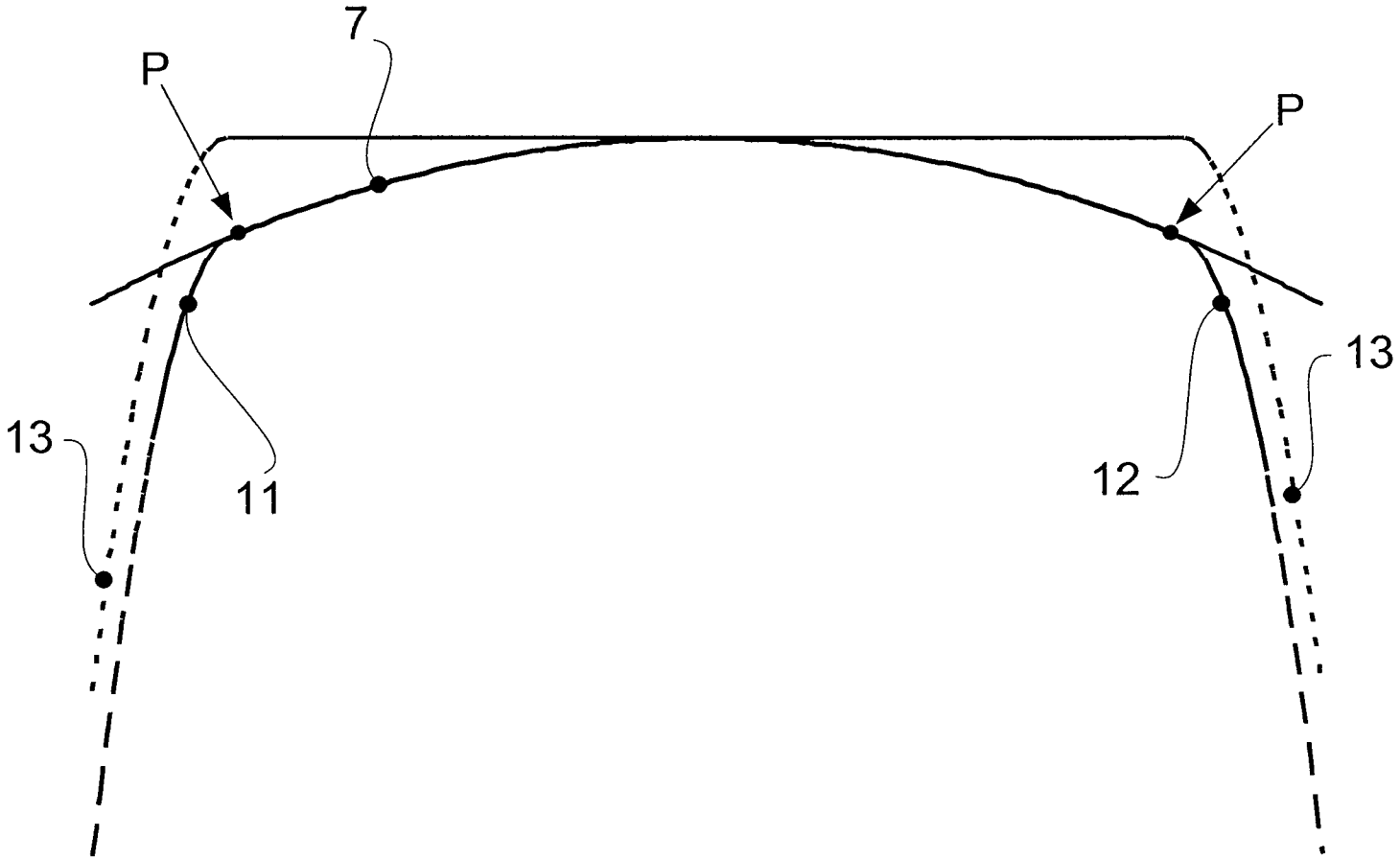
FIG. 8 shows a contoured roll with positive roll crowning and a chamfer according to the invention.

FIG. 8 shows for example the crowned profile, illustrated over the length of the barrel, of the roll barrel contour 7 described by a non-linear function on a supporting roll in a four-high stand or on an intermediate roll or a supporting roll in a six-high stand. The dash-dotted lines 13 illustrate the profile of the chamfer function independently of the profile of the roll barrel contour 7. The profile of the corrected barrel contour 11, 12 is illustrated by dotted lines. At the transitional point P of the roll contour 7 to the corrected barrel contour 11, 12, both curve profiles have the same pitch.

Figure 9:
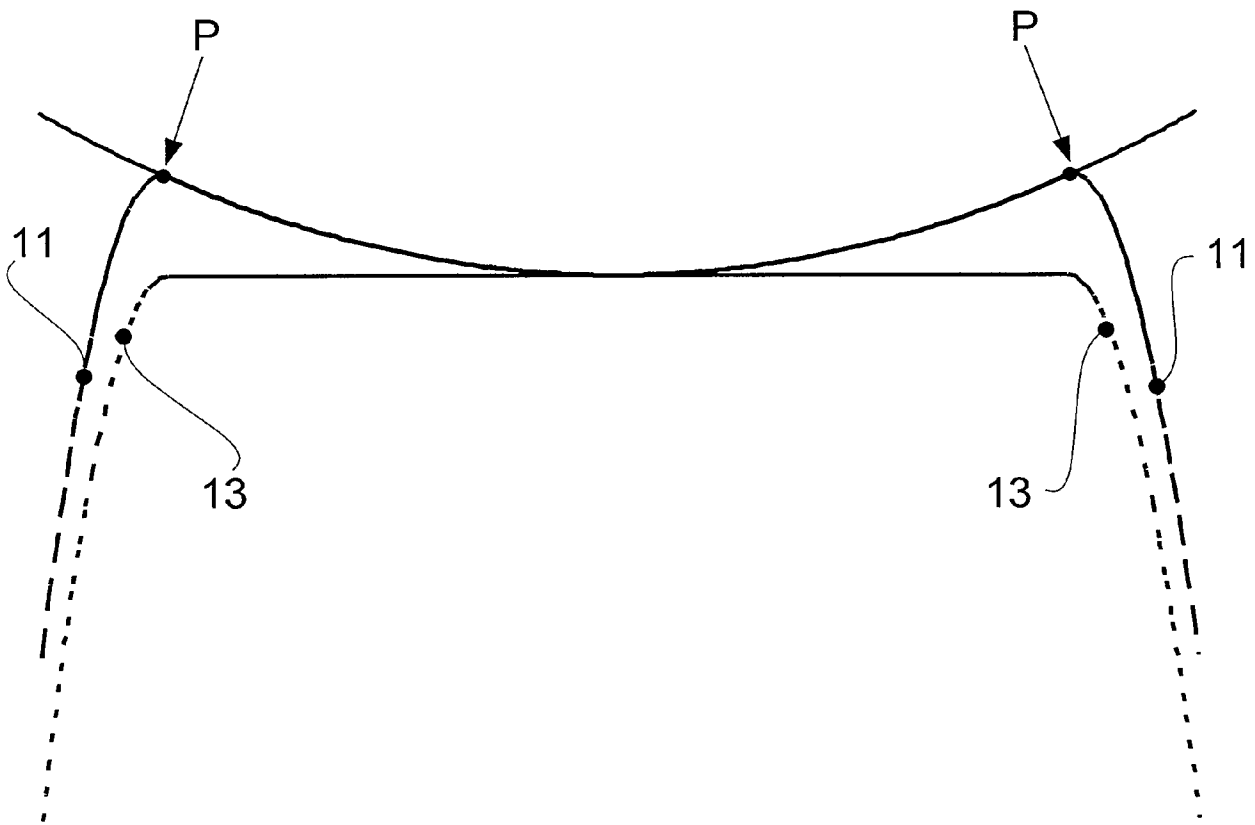
FIG. 9 shows a contoured roll with negative roll crowning and a chamfer according to the invention.

FIG. 9 shows the analogous conditions in the case of a roll barrel contour that is characterized by a negative roll crowning on the roll.

Figure 10:
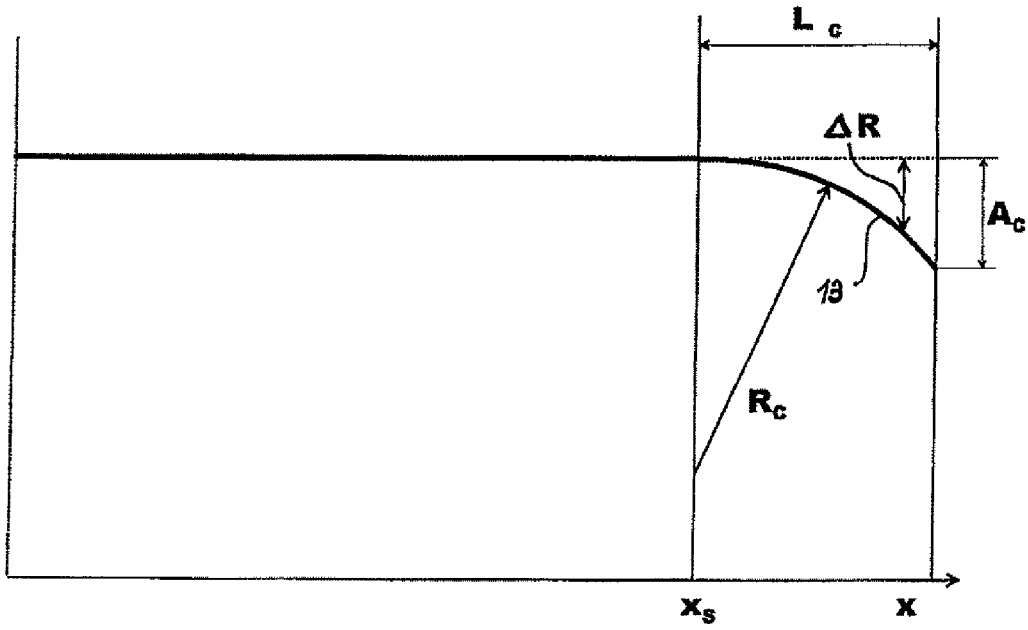
FIG. 10 shows the illustration of a possible chamfer function according to the invention.

FIG. 10 shows the profile of the chamfer function 13 in the example of a geometric function. In the case of a circular chamfer function, the amount to be subtracted ΔR at each point x outside the chamfer starting position $x_S$, i.e. at the interval of the chamfer length $L_C$, can be calculated by means of the formula $$\Delta R = R_C - \sqrt{R_C^2 - (x - x_S)^2}$$

where x is the coordinate in the axial direction of the roll $x_S$ is the chamfer starting position $L_C$ is the chamfer length $R_C$ is the chamfer radius $A_C$ is the chamfer amplitude with respect to the radius of the roll.

The invention claimed is:

1. A rolling mill stand for the production of rolled strip or sheet metal, comprising working rolls having a barrel contour described by a non-linear function, extending in a common length direction, and together defining roll nip, and a respective supporting roll outward of the nip at each working roll and supporting the working roll, at least one of the supporting rolls having marginal regions of a longitudinal extent thereof, and the at least one of the supporting rolls having a barrel contour which runs over an entire effective barrel length of the at least one of the supporting rolls and is described by a non-linear function, and the barrel contour of the at least one of the supporting rolls having a chamfer in at least one marginal region of its longitudinal extent each chamfer forming a corrected barrel contour in the at least one marginal region, the corrected barrel contour being described by a non-linear function, a first pitch of the barrel contour and a second pitch of the corrected barrel contour being identical at the transition point from the barrel contour to the corrected barrel contour, the corrected barrel contour being obtained by subtracting a non-linear mathematical chamfer function from the barrel contour described by the non-linear function, the load distribution between the at least one of the supporting rolls and the working roll contacting the at least one of the supporting rolls being equalized over the barrel contour of the at least one of the supporting rolls in comparison to the load distribution between a supporting roll with a cylindrical barrel contour and a working roll with a barrel contour described by a concave-convex function over the barrel contour of the supporting roll outside of the marginal regions of the supporting roll.

2. The rolling mill stand for the production of rolled strip or sheet metal as claimed in claim 1, wherein the at least one marginal region of the longitudinal extent of the at least one of the supporting rolls is both marginal regions of the longitudinal extent of the at least one of the supporting rolls, and a working roll of the working rolls and a supporting roll of the at least one of the supporting rolls are adjacent to each other and interact with each other, the working roll and the supporting roll completing one another fully in a non-loaded state.

3. The rolling mill stand as claimed in claim 1, wherein the chamfer function is a trigonometric function.

4. The rolling mill stand as claimed in claim 1, wherein the chamfer function is a sine function.

5. The rolling mill stand as claimed in claim 1, wherein the chamfer function is a second order function.

6. The rolling mill stand as claimed in claim 1, wherein the supporting rolls are in a four-high stand with the working rolls, and the supporting rolls are provided with the corrected barrel contour.

7. The rolling mill stand as claimed in claim 1, wherein the working rolls are axially displaceable, and barrel contours of the working rolls complete each other at a certain relative axial position of the working rolls.

8. A rolling mill stand for the production of rolled strip or sheet metal, comprising working rolls having a barrel contour described by a non-linear function, extending in a common length direction, and together defining roll nip, a respective intermediate roll outward of the nip at the working roll and supporting the working roll, and a respective supporting roll outward of the nip and supporting a respective one of the intermediate rolls, at least one of the intermediate rolls and the supporting rolls having marginal regions of a longitudinal extent thereof, and the at least one of the intermediate rolls and the supporting rolls having a barrel contour which runs over an entire effective barrel length of the at least one of the intermediate rolls and the supporting rolls and is described by a non-linear function, and the barrel contour of the at least one of the intermediate rolls and the supporting rolls having a chamfer in at least one marginal region of its longitudinal extent, each chamfer forming a corrected barrel contour in the at least one marginal region, the corrected barrel contour being described by a non-linear function, a first pitch of the barrel contour and a second pitch of the corrected barrel contour being identical at the transition point from the barrel contour to the corrected barrel contour, the corrected barrel contour being obtained by subtracting a non-linear mathematical chamfer function from the barrel contour described by the non-linear function, the load distribution between the at least one of the intermediate rolls and the supporting rolls and the working roll contacting the at least one of the intermediate rolls and the supporting rolls being equalized over the barrel contour of the at least one of the intermediate rolls and the supporting rolls in comparison to the load distribution between an intermediate roll or a supporting roll with a cylindrical barrel contour and a working roll with a barrel contour described by a concave-convex function over the barrel contour of the intermediate roll or the supporting roll outside of the marginal regions of the intermediate roll or the supporting roll.

9. The rolling mill stand for the production of rolled strip or sheet metal as claimed in claim 8, wherein the at least one marginal region of the longitudinal extent of the at least one of the intermediate rolls and the supporting rolls is both marginal regions of the longitudinal extent of the at least one of the intermediate rolls and the supporting rolls, and an intermediate roll of the at least one of the intermediate rolls and a supporting roll of the at least one of the supporting rolls are adjacent to each other, the intermediate roll and the supporting roll completing one another fully in a non-loaded state.

10. The rolling mill stand as claimed in claim 8, wherein the chamfer function is a trigonometric function.

11. The rolling mill stand as claimed in claim 8, wherein the chamfer function is a sine function.

12. The rolling mill stand as claimed in claim 8, wherein the chamfer function is a second order function.

13. The rolling mill stand as claimed in claim 8, wherein the working, intermediate and supporting rolls together are in a six-high stand, and the supporting rolls and/or the intermediate rolls in the six-high stand are provided with the corrected barrel contour.

14. The rolling mill stand as claimed in claim 8, wherein the intermediate rolls are axially adjustable, and the intermediate roll and the supporting roll complete one another fully in the non-loaded state in an undisplaced axial position of the intermediate rolls.

* * * * *